United States Patent [19]

Gravely

[11] Patent Number: 4,475,466

[45] Date of Patent: Oct. 9, 1984

[54] BURNER AND INCINERATOR SYSTEM FOR LIQUID WASTE

[75] Inventor: David A. Gravely, Louisville, Ky.

[73] Assignee: Pyrochem, Inc., Louisville, Ky.

[21] Appl. No.: 350,534

[22] Filed: Feb. 19, 1982

[51] Int. Cl.[3] ..... F23G 7/04

[52] U.S. Cl. ..... 110/238; 110/347; 431/283

[58] Field of Search ..... 110/235, 347; 431/283

[56] References Cited

U.S. PATENT DOCUMENTS

| | | |
|---|---|---|
| 391,735 | 10/1888 | Bullard . |
| 1,128,184 | 2/1915 | Pohl . |
| 1,262,546 | 4/1918 | Muhlfeld . |
| 1,269,132 | 6/1918 | Tierney . |
| 1,757,847 | 5/1930 | Shutt . |
| 1,788,716 | 1/1931 | Hepburn . |
| 1,976,528 | 10/1934 | Vandeveer . |
| 1,995,723 | 3/1935 | Van Denburg . |
| 2,042,058 | 5/1936 | Jefferson . |
| 2,137,185 | 11/1938 | Seil . |
| 2,452,843 | 11/1948 | Esnault-Pelterie . |
| 2,466,258 | 4/1949 | Morgan . |
| 2,847,063 | 8/1958 | Reed et al. . |
| 3,115,120 | 12/1963 | Durham . |
| 3,115,851 | 12/1963 | Ceely . |
| 3,168,074 | 2/1965 | Kuhner et al. . |
| 3,357,375 | 12/1967 | Brophy . |
| 3,421,462 | 1/1969 | Wessberg . |
| 3,559,595 | 2/1971 | Appelhans et al. . |
| 3,604,375 | 9/1971 | Bruns et al. . |
| 3,611,954 | 10/1971 | Monroe, Jr. . |
| 3,718,102 | 2/1973 | Hemsath et al. . |
| 3,805,714 | 4/1974 | Sharp . |
| 3,822,653 | 7/1974 | Ghelfi . |
| 3,828,700 | 8/1974 | Ragot . |
| 3,834,326 | 9/1974 | Sowards . |
| 3,892,190 | 7/1975 | Sharpe . |
| 3,974,021 | 8/1976 | Bernadiner et al. . |
| 3,985,494 | 10/1976 | Childree . |
| 4,206,711 | 6/1980 | Konrad ..... 110/238 |
| 4,351,252 | 9/1982 | Shimdome et al. ..... 110/238 X |

*Primary Examiner*—Edward G. Favors

*Attorney, Agent, or Firm*—Pollock, Vande Sande & Priddy

[57] ABSTRACT

Disclosed is a liquid waste combustion system having a burner comprising a combustion chamber and first, second and third spaced apart injectors positioned outside of the combustion chamber and arranged so as to inject separate unconfined streams of first, second and third waste liquids into the combustion chamber, the axes of the waste streams defining a substantially conical surface converging at an apex within the combustion chamber and the waste streams mixing in the area of this apex. The first waste liquid has a BTU value below that required for combustion, the second waste liquid has a BTU value at least high enough to support combustion, and the third waste liquid has a BTU value significantly greater than that of the second liquid such that the waste mixture is combustible. Means are provided for supplying combustion-supporting gas to the combustion chamber and for igniting the waste mixture within the combustion chamber. Means may also be provided for controlling relative to each other the rates of injecting the first and third waste liquids and this control means may be responsive to one or more characteristics of the combustion products and/or combustion conditions, such as combustion temperature. Retention means may be provided for maintaining combustion product temperature above at least about 2,000° F. for at least about 2 seconds and may include a rotary kiln and downstream retention chamber in communication with the combustion chamber.

27 Claims, 5 Drawing Figures

BURNER AND INCINERATOR SYSTEM FOR LIQUID WASTE

TECHNICAL FIELD

This invention relates to processes and systems for disposing of waste materials, and more particularly to processes and systems for disposing of liquid wastes by combustion.

BACKGROUND OF THE INVENTION

A continuing problem in many industrial processes is the disposal of industrially generated wastes. Pollution control laws prohibit the disposal of waste materials in ways which contaminate the environment. Consequently, the discharge of many gaseous products and particulate materials to the atmosphere, the discharge of liquid and solid waste into bodies of water, and even the disposal of liquids and solids on land are restricted. A desirable and convenient way to dispose of wastes is to destroy them by complete combustion of the wastes. Disposal by combustion is especially useful and potentially economical for wastes which are at least in part combustible. Substantially complete combustion requires a heating value for liquid waste of at least about 90,000 BTU per gallon, and air in the amount of at least about 7.5 pounds per 10,000 BTU.

Many residues are not completely converted to innocuous substances when burned in the open, and many devices and processes have been suggested for disposing of waste by combustion processes. However, the burning of many wastes presents problems. EPA regulations require 99.9 percent combustion efficiency together with a minimum burning temperature and retention time at burning temperature for combusting hazardous wastes. In order for these requirements to be met, it is necessary for the waste to burn with consistent heat values and burning characteristics. However, many wastes comprise a mixture of various substances, and may comprise mixtures of liquids and solids, the components of which have heating values from about zero to very high levels. The waste may comprise a mixture of components having different specific gravities such that these components separate upon standing. Further, different liquid fractions may have different viscosities and/or concentrations of solids. Highly viscous liquids, and liquids containing solids, can plug burner nozzles, stopping the flow of combustible liquids and causing the flame to go out. Further, many wastes contain a sufficient amount of water so that they are incapable of supporting combustion. While such liquids can be mixed with liquids having a high enough BTU value so that the mixture is combustible, the aqueous phase tends to separate from the mixture. This solution, i.e., that of adding a sufficient amount of high BTU liquid to make a combustible mixture, is inefficient in its use of the heating value of the waste.

DISCLOSURE OF THE INVENTION

It is accordingly one object of this invention to provide an improved burner for combusting wastes comprising liquids of different BTU values.

It is another object to provide a burner capable of maintaining a steady flame while simultaneously burning a plurality of liquid wastes having different heating values.

It is another object to provide a burner capable of maintaining a steady flame while burning liquid wastes having a high viscosity and/or containing suspended solids.

It is another object to provide a burner capable of combusting a plurality of liquid wastes, at least one of which has too low a heating value to support combustion.

It is still another object to provide an improved burner for efficiently burning liquid waste one component of which may consist essentially of water.

It is another object to provide a combustion system and process which meets or exceeds pollution control regulations for disposing of combustible hazardous liquid wastes.

In accordance with this invention a burner has been provided for combustion of liquid wastes comprising: wall means defining a combustion zone, said combustion zone having an open end for emission of combustion products; means for injecting first, second, and third liquid streams into said combustion zone, said means comprising first, second, and third spaced apart injectors positioned outside of said combustion zone, the axes of said injectors being oriented so that they define a conical surface and said liquid streams converge at the apex of said conical surface, said apex lying within said combustion zone; means for introducing first, second, and third liquids to said first, second, and third injectors, respectively, said first liquid having a BTU value below that required to support combustion, said second liquid having a BTU value at least high enough to support combustion, and said third liquid having a BTU value significantly greater than that of said second liquid; means for introducing combustion-supporting gas into said combustion zone; means for igniting the injected waste streams; and, means for controlling relative to each other the rates of injecting said first and third waste streams into said combustion zone.

Further, in accordance with one aspect of this invention, means are provided for measuring at least one characteristic of the combustion products, such as temperature or composition, and means responsive to said characteristic(s) for controlling the flow rate of at least one of said first or third streams. Substantially complete combustion, i.e., at least 99.9 percent complete combustion is achieved by maintaining control over (1) amount of combustion-supporting gas, (2) temperature of combustion, and (3) retention time of combustion products at combustion temperatures.

In carrying out this invention different waste materials may be stored separately in accordance with their BTU content, and a stream of each is introduced separately into the combustion zone, thus avoiding problems arising when liquids are mixed externally before being fed to a combustion zone. Further, in the preferred method of carrying out this invention, means are provided for monitoring the conditions within the combustion zone which, together with means responsive to these conditions for adjusting one or more flow rates, produces a stable flame even though one or more of the waste streams changes in composition.

In the preferred method of carrying out this invention each liquid stream is forced from the injector with a high pressure gas which atomizes the liquid upon its emission from the injector nozzle. The extremely fine droplets which are produced are more rapidly and completely combusted than are larger droplets.

The system and process of this invention are capable of exceeding the combustion temperature and retention time at combustion temperature required by regulation for wastes such as polychlorinatedbiphenyl (PCB) and pathogens.

DETAILED DESCRIPTION OF THE DRAWINGS

Figure 1:
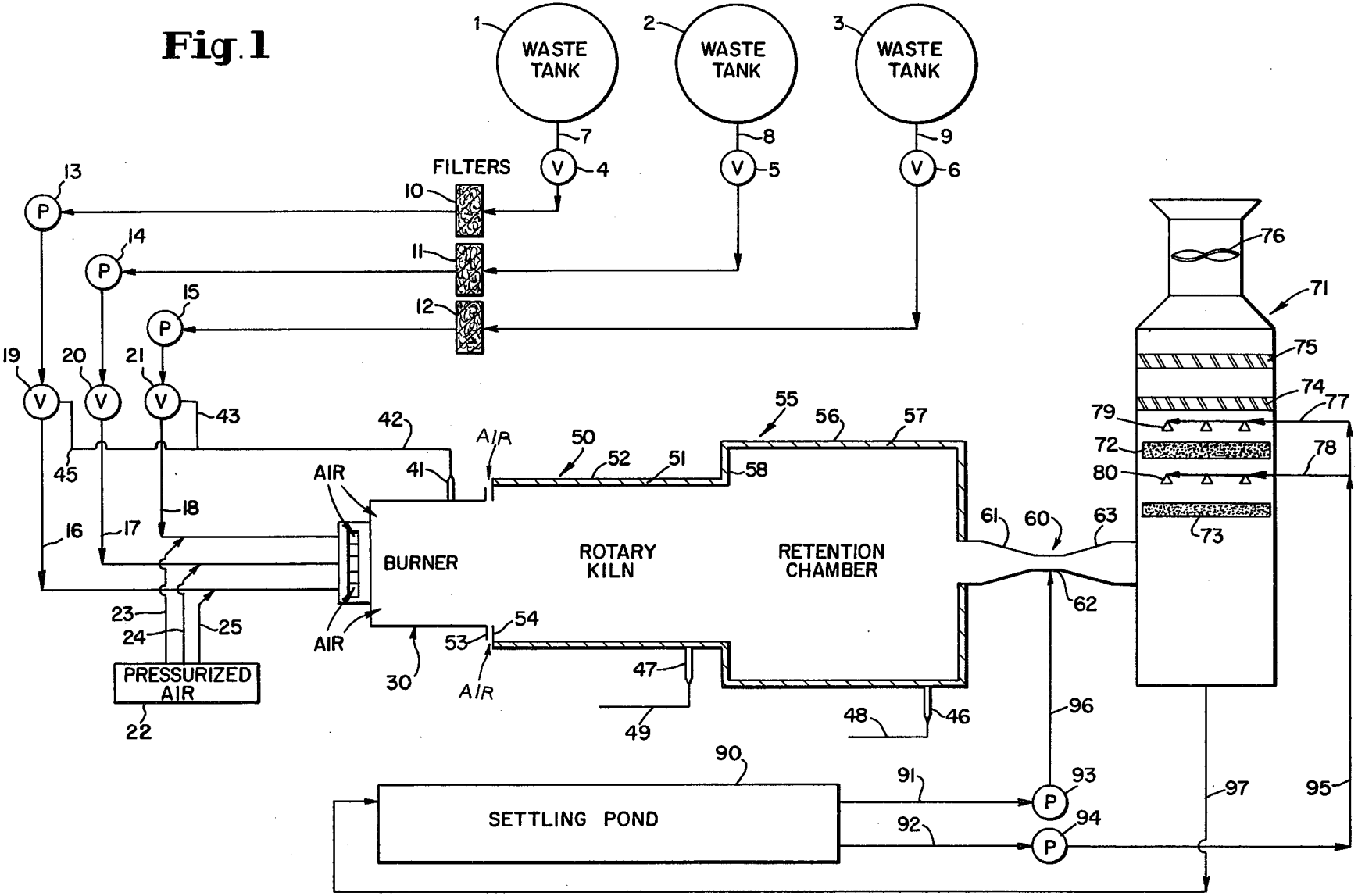
FIG. 1 is a schematic diagram of a complete liquid waste system employing the burner and combustion system of this invention.

Referring to FIG. 1, waste tanks 1, 2 and 3 represent sources of three different liquid wastes, tank 1 containing liquid waste having too low a heating value to support combustion, tank 2 containing liquid waste having a heating value just capable of supporting combustion, and tank 3 containing liquid waste having a heating value significantly greater than that required for its combustion. Each tank shown in FIG. 1 represents one or more sources of liquid wastes or storage zones, and merely depicts a source of three different waste liquids. The liquid in each tank may contain suspended solids and, although one advantage of this invention lies in the mixing of liquids in the combustion chamber, the invention includes the use of a mixture of liquids as one or more streams. The liquid from waste tanks 1, 2 and 3, respectively, flows through lines 7, 8 and 9, valves 4, 5 and 6, filters 10, 11 and 12, and pumps 13, 14 and 15 to control valves 19, 20 and 21.

The valves 4, 5 and 6 are provided as a means for isolating the liquids in the tanks from the rest of the system, such as may be necessary during maintenance of the system, and normally are open. These valves may be any conventional commercially available valves which are compatible with the liquid wastes.

The filters 10, 11 and 12 may be commercially available filters for separating solids from liquids and are provided to remove particulate solids from the waste streams which may be large enough to clog the injectors if present in the streams passing into the burner. The filters preferably have the capability of removing particles larger than $\frac{1}{4}$ inch, and most preferably particles larger than $\frac{1}{8}$ inch in diameter. Other solids-liquid separation devices such as centrifuges or hydroclones may be used. However, filters are preferred.

The pumps 13, 14 and 15 are provided to pressurize the liquid waste streams and force them into the burner through the injectors. Conventional commercially available centrifugal or positive displacement pumps compatible with the liquid wastes and having the requisite pressure and volumetric capabilities may be used.

The relative quantities of liquids passing through lines 7, 8 and 9 are controlled at valves 19, 20 and 21, to provide a stable flame at a temperature in the burner high enough to ensure essentially complete combustion. The liquid wastes pass from valves 19, 20 and 21 through lines 16, 17 and 18, respectively, to injectors 28, 27 and 26 (see FIG. 2 and FIG. 5) respectively, where they are forced into the burning zone with pressurized air.

The valves 19 and 21 are preferably motorized and activated by sensors. Valve 20 may also be motorized and activated by sensors; however, since the liquid stream controlled by valve 20 has a heating value equal to or slightly greater than that required for combustion, changes in the rate of flow of waste from line 8 will not significantly affect the combustion characteristics of the mixture of liquid wastes. Typical useful valves for controlling the flow of wastes are exemplified by the 1813 motorized Sensitrol valve sold by North American Mfg. Co., the 12 TBV-M Motorized Butterfly valve sold by Pyronics, Inc., and Barber-Coleman valves available from the Barber-Coleman Company.

The extent to which the valves are open is controlled by sensors which are activated by signals transmitted from thermocouple 41 through electrical lines 42, 43 and 45. The thermocouples must be capable of withstanding and sensing temperatures as high as those encountered in the burner, and preferably as high as about 2,600° F. Typical useful thermocouples are the Chromel-Alumel thermocouples sold by Omega Engineering which, with added shielding, may be used to temperatures as high as about 2,600° F.

Other means of controlling the relative amounts of liquid wastes delivered to the injectors, such as devices to control pump speed, may be used and are within the scope of this invention.

Figure 4:
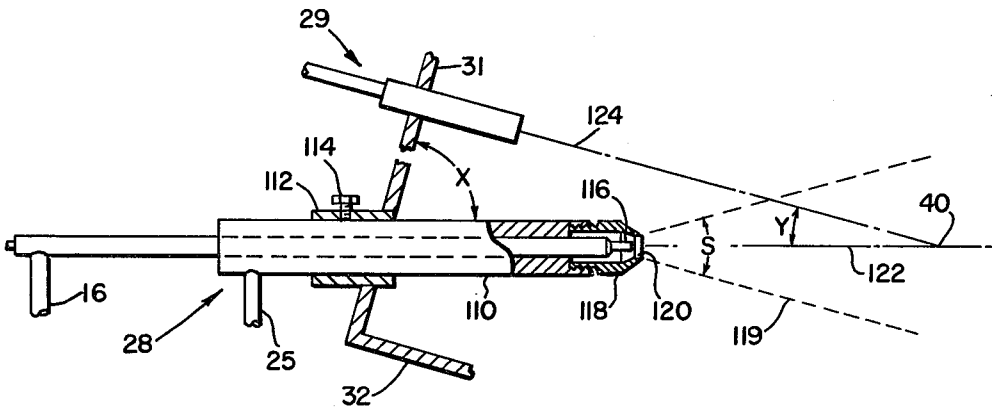
FIG. 4 is a schematic diagram of a burner injector.

The injectors 26, 27 and 28 (see FIG. 2) serve the functions of atomizing the liquid wastes so that they are more readily and completely combusted and directing the atomized, unconfined streams of liquid waste into the combustion zone. The preferred injector, an illustrative embodiment of which is shown in FIG. 4, is provided with means for mixing high pressure gas such as air or steam with the liquid waste. The Series 5622 oil atomizer available from North American Mfg. Co. exemplifies an injector structure which may be used.

Figure 2:
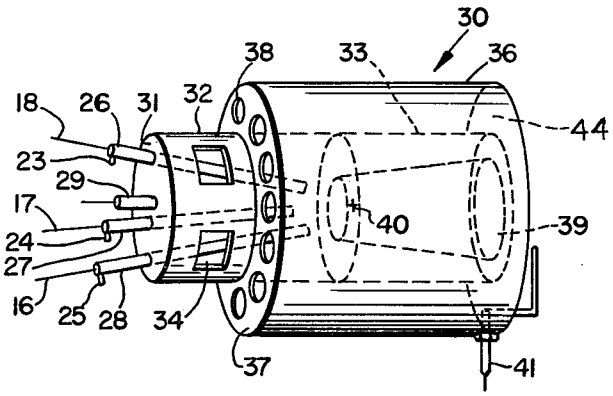
FIG. 2 is a view in perspective of the burner of this invention.

As shown in FIG. 2, the injectors extend through a burner face plate 31 and are spaced apart and oriented so that the axes of the injectors define an imaginary cone having an apex 40 within an outwardly tapered combustion chamber 33' formed by the wall of a cylindrical refractory liner 33 carried within an inner burner shell 32. Preferably, apex 40 is located about 0 to 6 inches, more preferably about 3 to 4 inches, within the plane of the inlet opening into chamber 33' and substantially on the geometric center axis 124 of the chamber. The discharge ends of the injectors within shell 32 are preferably equally spaced apart by a distance in the range of about 4 to about 6 inches and this distance is preferably adjustable by moving each injector along its longitudinal axis either away from or toward apex 40. For this purpose, the body 110 of each injector may be slidably mounted in a sleeve 112 carried by face plate 31 as shown in FIG. 4, a set screw 114 being provided to secure the injector at the axial position desired. The injectors are canted toward axis 124 such that the conical angle at apex 40 is about 40° to 80°, more preferably about 40° to 60°, most preferably about 46°.

As seen best in FIG. 2, the inner ends of injectors 26, 27 and 28 are spaced a substantial distance from liner 33 and do not extend into combustion chamber 33'. This avoids damage to the injector when the cooling flow of waste liquid is shut off while liner 33 is still hot because the heat initially retained by this liner can be at a sufficiently high level to melt a metallic nozzle within chamber 33' or otherwise in close proximity to the heated mass of the liner.

As shown in FIG. 4, the injectors include a waste nozzle 116 and a gas or steam nozzle 118, the latter comprising an atomizing nozzle and being adjustable and/or exchangable so as to provide a conical spray 119 diverging radially outward from the axis of nozzle opening 120 at a preselected spray angle "S". Spray angle "S" is preferably in the range of about 15 to about 60 degrees, more preferably about 22.5 to about 45 degrees, 22.5 degrees being preferred for wastes of relatively low viscosity and 45 degrees being preferred for wastes of relatively high viscosity. The central axis 122 of the conical spray, which is an extension of the longitudinal axis of the elongated injectors, intersects the combustion chamber axis 124 at an angle "Y" preferably in the range of about 20 to 40 degrees, more preferably about 20 to 30 degrees, most preferably about 23 degrees. Combustion chamber axis 124 preferably coincides with the axis of pilot burner 29 as shown in FIG. 4 and both of these axes preferably lie on the geometric center axes of cylindrical inner shell 32 and cylindrical outer shell 36.

The injector arrangement described insures formation of a combustible mixture within chamber 33' in the area of apex 40 while maintaining the atomizing nozzles at a sufficient distance from liner 33 to avoid damaging the injectors during normal or emergency shutoff of waste flow. In order to achieve the foregoing spray intersection angles, injector body 110 and its associated mounting sleeve are mounted at an angle "X" relative to the plane of face plate 31, angle "X" preferably being in the range of 50 to 70 degrees, more preferably 60 to 70 degrees, most preferably about 67 degrees.

Pilot burner 29, shown in FIG. 2 and FIG. 4, also extends through face plate 31, and is provided with a source of gas or oil (not shown). The pilot burner sends a flame through the apex of the imaginary cone defined by the converging waste streams and thus ignites the liquid waste mixture formed by these streams in the immediate area of the cone apex.

Air for ignition and initial burning of the atomized liquid, referred to as primary air, flows into the combustion zone through louvered openings 34 in inner shell 32 of burner 30. Means (not shown) are provided for adjusting the size of the openings 34, and thus the rate of air admitted to the combustion zone.

The combustion products passing from the burner assembly 30 are contacted at exit end 39 of the burner assembly with additional air, referred to as secondary air. This air enters the burner assembly through louvered ports 38 in annular end closure 37 and flows in the annular passageway between the inner shell 32 and outer shell 36 toward the end 39. Adjacent end 39, the secondary air flows concentrically around the still burning core of combustible materials emitted from chamber 33', causing the flame pattern to expand and fill the drum of a rotary kiln 50. The rate of air flow through ports 38 may be controlled by the use of an annular face plate (not shown) having holes to register with those of plate 37 when rotated. The combustion flame passing into rotary kiln 50 is contacted with additional air, referred to as tertiary air, flowing into the system between shield 53 and end wall 54. The resulting combustion products then pass into a stationary combustion product retention chamber 55 having a friction seal 58 in sliding contact with an outer shell 52 of kiln 50. The rotary kiln comprises an outer shell 52 and refractory lining 51. The retention chamber 55 comprises outer shell 56 and refractory material 57. Outer shells 32, 36, 52 and 56 are preferably cylindrical in shape and made of metallic material.

The rotary kiln 50 and retention chamber 55 are sized to provide a sufficient hold-up time for the combustion products to ensure substantially complete combustion. The refractory material in the burner 30, kiln 50 and retention chamber 55 serves not only to protect the outer metallic shell of the unit but also to maintain a sufficiently high temperature so that the combustion products will be retained at an elevated temperature to thereby complete combustion.

Thermocouples 46 and 47 in the retention chamber and the rotary kiln respectively are for monitoring the temperature and thus the conditions within the combustion gas retention zones. Electrical lines 48 and 49 lead from these thermocouples to devices to record the temperatures and/or control the process as by shutting down the system if required conditions are not being met. These, or additional thermocouples, may be placed at various locations in the system, the number and their placement determined by anticipated needs of the system.

The combustion products pass from the retention chamber 55 into inlet 61 of venturi 60 where they are mixed with a stream of water forced into the throat 62 of venturi from pump 93. The resulting mixture of atomized water and hot gases leaves the venturi 60 through outlet 63 and passes into tower 71.

The combustion gases pass upwardly through the tower through packing 72 and 73 and water sprays from sprayers 79 and 80 pumped into the tower by pump 94 through lines 95, 78 and 77. The scrubbed gases pass upwardly in the tower through demisters 74 and 75 and are forced out by fan 76. The liquid in the tower carrying suspended particles and dissolved impurities flows into settling pond 90 through line 97, and clarified water is recycled to pumps 93 and 94 through lines 91 and 92, respectively.

Referring to FIG. 2, liquid wastes are introduced into injectors 26, 27 and 28. The streams emitted from the nozzles of these injectors converge at a point where they are contacted with a flame from pilot burner 29. As noted above, primary air is introduced into the combustion zone through louvered ports 34 in the inner shell 32 of burner 30.

Secondary air to complete the combustion of the gases formed in the combustion zone passes through louvered ports 38 in annular end closure 37 which extends between inner shell 32 and outer shell 36. This air, in passing through the annular zone formed between shells 32 and 36, raises the temperature of the air and thus helps achieve more complete combustion as it contacts the hot combustion gases at the exit end 39 of the burner.

Figure 3:
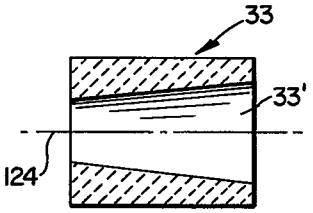
FIG. 3 is a vertical sectional view of the refractory insert for the burner.

FIG. 3 shows a cross-section of refractory liner 33 within the burner.

FIG. 4 shows a simplified structure for burner injector 28 having waste line 16 and pressurized air line 25.

Figure 5:
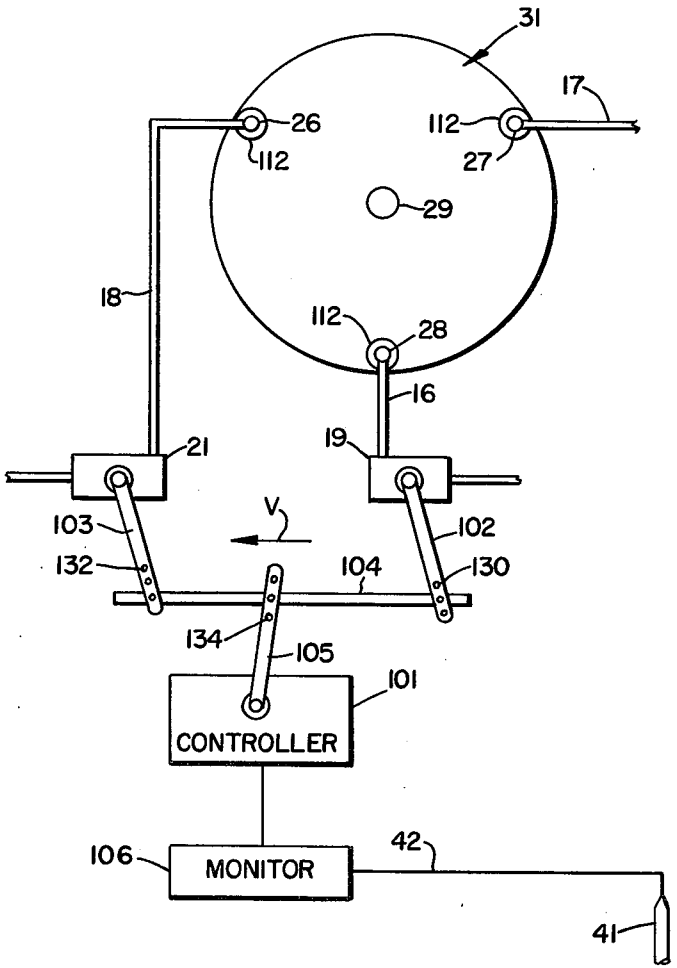
FIG. 5 is a schematic diagram showing the burner face plate and a control system for regulating waste flow to the burner injectors.

FIG. 5 is a schematic diagram of a system for controlling the ratio between flow rate of low heat value waste and flow rate of high heat value waste introduced into the burner. Temperature monitor 106, responsive to thermocouple 41, causes controller 101 to adjust valves 19 and 21 through linkage means 102, 103, 104 and 105. Movement of these linkages in the direction of arrow V increases the flow of high heat value waste through line 18 to injector 26 and decreases the flow of low heat value waste through line 16 to injector 28. A first series of apertures 130 and a second series of apertures 132 in linkages 102 and 103, respectively, permit adjustments in the lengths of the lever arms through which linkage 104 acts to rotate the stems of valves 19 and 21, respectively. These adjustments provide for variations in the amount of flow rate change provided by each valve in response to a given amount of axial movement by linkage 104. Similarly, a third series of apertures 134 in linkage 105 permits adjustments in the amount of axial movement imparted to linkage 104 by a given amount of pivotal movement by linkage 105. Each of these adjustments provide means for fine tuning the system for controlling relative to each other the rates of injecting the low and high heat value liquids into the combustion zone, depending upon the relative heat values of those liquids and their viscosities and other physical characteristics.

In carrying out the process of this invention, the three waste streams are injected at relatively high pressure, e.g., 100 psi, into the burner, the relative amounts of each stream being controlled so that the resulting mixture has a BTU content at or above the point at which the mixture will burn without an external source of energy. The relative amounts of the streams can be controlled manually; however, in the preferred method of carrying out this invention the streams are controlled automatically to maintain the temperature in the combustion chamber at a desired level. In the preferred method of carrying out this invention the rate of air flow and relative amounts of each waste stream are adjusted manually until the desired temperature and combustion conditions are reached and automatic controllers activated by a sensor such as a thermocouple and then used to maintain this condition.

In order to prolong the life of the refractory materials in the burner kiln and retention chamber, the burner is preferably operated at as low a temperature as is consistent with regulatory requirements. The refractory material preferably contains at least about 90 wt% alumina and is able to withstand temperatures at least as high as 3,000° F. for at least short periods of time.

Some hazardous wastes must be burned at a minimum temperature. For example EPA regulations require at least 2,000° F. and a retention time of at least 2 seconds at that temperature for combustion of PCB.

Although it is preferred that the temperature be at or below about 2,100° F., the temperature may periodically be raised to temperatures as high as 2,500° F. to rid the combustion chamber and kiln of accumulated deposits of solid slags. It is preferred that the temperatures not exceed about 2,600° F. since the life of the refractories is reduced significantly as the temperature is raised above about 2,600° F. even for short periods of time.

Referring to FIGS. 1 and 2, air flows into the combustion chamber and into contact with liquid wastes and combustion products by four routes. Atomization air atomizes the liquid wastes as they are dishcarged from the respective injectors. Primary air initiates the combustion by contacting the atomized liquid wastes at the apex of the imaginary cone and enters the combustion chamber through louvered ports 34 in the inner shell 32 of burner 30. The area of openings 34, and thus the rate of air flow through the openings, is controlled by means (not shown) for adjusting the size of these openings. Additional air is brought into contact with the combustion products downstream from burner liner 33. This air, referred to as secondary air, enters the burner 30 through louvered ports 38 in the annular chamber between the outer shell 36 and inner shell 32 of burner 30. Secondary air contacts the combustion products at the exit end of burner 30. The control of air through louvers 38 is affected by means (not shown) for adjusting the size of these ports. Yet additional air, referred to as tertiary air, is introduced into the system through the space between the burner and the rotary kiln defined by burner shield 53 and end wall 54 of kiln 50.

The amount of tertiary air may be regulated by adjusting the space between shield 53 and end wall 54 by axially moving the burner with respect to the rotary kiln. The quantity of air needed for complete combustion of a given volume of liquid waste changes as the heating value of the liquid changes. A liquid having a heating value of about 120,000 BTU per gallon will require about 1,620 $ft^3$ of air per gallon at standard temperature and pressure for complete combustion. An excess of at least about 20 percent is preferred.

The pilot burner to initiate the burning preferably burns continuously at a heat output sufficiently high to initiate the burning and restart it in the event the flame goes out. A constant heat output of about 240,000 BTU's per hour has been found to be satisfactory.

In starting the process of burning liquid wastes, the temperature may first be adjusted to the desired value, such as about 2,020° F. to 2,050° F. depending on the instrument error of the control system, by manually regulating liquid waste flow and air flow rates. Once the operating temperature is reached the automatic controller may be set at that temperature. In the preferred method of carrying out the invention, fluid controllers in response to automatic control are used on either one or both of the essentially non-combustible and the very combustible liquid streams. A controller on the intermediate BTU waste streams which has a BTU value which is equal to or slightly greater than that required to support combustion will normally serve no function since changes in the volume of this stream usually will not affect the combustibility of the mixture to a significant extent. The intermediate BTU stream functions primarily to provide an essentially stable flame to maintain the desired temperature level.

In carrying out this process, the low BTU liquid waste may have a BTU value from about 0 to about 80,000 BTU per gallon, preferably from about 10,000 to about 60,000 BTU per gallon. The intermediate BTU liquid waste may have a BTU value in the range from a value which is capable of supporting combustion to one which is slightly higher, i.e., from about 90,000 to about 100,000 BTU per gallon, preferably about 100,000 BTU per gallon. The high BTU liquid waste (or, optionally, liquid fuel if liquid waste of the requisite fuel value is not available) has a BTU value at least about 10,000 BTU per gallon greater than the intermediate BTU liquid waste, and is preferably in the range from about 120,000 to about 130,000 BTU per gallon.

The system is preferably operated continuously to minimize destruction of the refractory liners through expansion and contraction resulting from changes in temperature.

ILLUSTRATIVE EXAMPLE

A burner system as shown in the figures is used to burn liquid wastes. The cylindrical inner shell 32 of the burner is about 30 inches in diameter, about 46 inches long and made of 3/16 inch hot rolled sheet steel. The refractory liner 33 is made from a moldable refractory composition containing about 90 wt% alumina, such as available from General Refractory, Inc. The molded liner is about 24 inches long, about 29½ inches in diameter, about 7¼ inches thick at the inlet and about 4 inches thick at the outlet. The combustion chamber formed by this liner has an inlet opening about 15 inches in diameter and an outlet opening about 2½ inches in diameter. The louvers in the inner shell have a maximum open area of about 130 square inches.

The injectors mounted on face plate 31 are about three feet long, and have a waste nozzle 116 with an internal diameter of about ⅝ inch. They are oriented so that their axes converge substantially on the axis of cylindrical inner shell 32 at a point about 3 to 4 inches within the entrance to combustion chamber 33' in refractory liner 33. Each injector mounting sleeve is positioned so that the longitudinal axis 122 of the injector is slanted inward toward the inner shell axis 124 at an angle of about 67° relative to the plane of face plate 31 and the central axis of the spray emitted by the injector converges toward apex 40 at an angle of about 23° relative to the inner shell axis. The injectors are adjusted axially and clamped in their corresponding sleeves so that the tips of atomizing nozzles 118 (on axis 122) are about 4 to 6 inches apart, each nozzle being axially adjusted within this range so as to achieve a centrally positioned and relatively uniform flame shape downstream of apex 40. In this position, the tip of each nozle is about 2½ to 3½, more preferably about 3, inches from shell axis 124 and about 4½ to 5½, more preferably about 5, inches from the closest boundary of the refractory mass comprising the body of insert 33 (about 2 to 2½ inches outside of the plane of the entrance opening to chamber 33' but spaced along a diagonal line about 4½ to 5½ inches from the mass defining the edge of this opening).

Pilot burner 29 is directed substantially along axis 124 of inner shell 32 so that its flame passes through the point of convergence of the injector axes, i.e., apex 40. The pilot burner is gas fired and has an energy of about 240,000 BTU per hour.

The outer shell 36 is about 40 inches in diameter and 36 inches long, having an outlet end 44 approximately even with the outlet of the combustion chamber 33'. The louvers in the annular end 37 between outer shell 36 and inner shell 32 have a maximum open area of about 225 square inches.

The rotary kiln is about 16 feet long and 8 feet in diameter and has a 3,000° F. refractory lining about 9 inches thick. The retention chamber is about 30 feet long, about 20 feet in diameter and is provided with a 3,000° F. refractory lining about 13 inches thick.

In starting the incinerator burner, the pilot burner is started and liquid waste having an energy value of about 100,000 BTU per gallon is introduced first into the combustion zone through injector 27 at a rate of about 200 gallons per hour, thus initiating burning. Thereafter, waste liquid liquid having a BTU content of about 130,000 BTU per gallon is introduced into the burner through injector 26 at a rate of about 600 gallons per hour; and waste liquid having a BTU content of about 10,000 BTU per gallon is introduced into the burner through injector 28 at a rate of about 200 gallons per hour. The wastes are introduced into the injectors at 25 psia and air at a pressure of 100 psia is introduced into all injectors to atomize the liquids and force them into the combustion zone.

The combustion air flow into the combustion chamber and areas between the combustion chamber and the rotary kiln is adjusted by manually moving the louvers and adjusting the axial position of the burner relative to the rotary kiln. The louvers are about 90 percent open at the operating temperatures. When the desired temperature of about 2,020° F. is reached the valve controller for the 10,000 and 130,000 BTU streams is activated, thus providing means for automatically adjusting the flow rate of these streams in response to signals from a thermocouple located in the combustion zone to maintain the temperature above about 2,000° F. A drop in temperature causes the controllers to adjust the valve openings to increase the rate of flow of high BTU liquid waste and decrease the rate of flow of low BTU waste, thus increasing the ratio of volume of the high BTU stream to the low BTU stream. An increase in temperature causes the controller to change the valve openings to decrease that ratio.

The overall burning rate is about 100,000,000 BTU per hour for a liquid waste disposal rate of about 1,000 gallons of liquid waste per hour, and the combined retention time of the combustion products in the burner, kiln and retention chamber at a temperature of about 2,000° F. is about 4 seconds.

Means are provided for shutting down the system if the temperature increases or decreases outside a predetermined range. These means are responsive to thermocouples within the burner, kiln and retention chamber. Failure to shut down the system if the temperature were to drop too low may result in failure to meet regulatory emission requirements. Too high a temperature may result in damage to equipment.

What is claimed is:

1. A burner for combustion of liquid wastes comprising:

wall means forming a combustion chamber, said combustion chamber having an outlet opening for emission of combustion products;

means for injecting first, second and third waste liquids into said combustion chamber as separate unconfined streams, said injection means comprising first, second and third spaced apart injectors positioned outside of said combustion chamber, said injectors being oriented so that the axes of said waste streams define a substantially conical surface and converge substantially at the apex of said conical surface, said apex lying within said combustion chamber and said waste streams mixing in the area of said apex;

means for introducing said first, second and third waste liquids to said first, second and third injectors, respectively, said first liquid having a BTU value below that required for combustion, said second liquid having a BTU value at least high enough to support combustion, and said third liquid having a BTU value significantly greater than that of said second liquid;

means for supplying combustion-supporting gas to said combustion chamber;

pilot means for igniting said waste mixture; and, control means for controlling relative to each other the rates of injecting said first and third waste liquids into said combustion chamber, said control means including means for measuring at least one characteristic of the combustion products related to combustion conditions and means responsive to said characteristic(s) for controlling the rate of injecting at least one of said first and third waste liquids into said combustion chamber.

2. The burner of claim 1 in which said measuring means measures the temperature within the combustion chamber and said responsive means is responsive to said temperature so as to control the rate of injecting at least one of said first and third liquids into said combustion chamber.

3. The burner of claim 1 wherein said wall means includes a cylindrical wall defining said combustion chamber and an end wall spaced at a substantial distance from said combustion chamber, and wherein said injection means and said pilot means are mounted on said end wall.

4. The burner of claim 1 wherein said injectors include means for contacting said liquids with a gas so as to provide atomized streams of said liquids, said gas being at a sufficiently high pressure to atomize said liquids.

5. The burner of claim 4 wherein said gas is air provided at a pressure of at least about 100 psia.

6. A liquid waste combustion system comprising:

wall means defining a combustion zone;

means for injecting first, second and third waste liquids into said combustion zone as separate unconfined streams, said means comprising first, second and third injectors positioned in spaced apart relationship to each other outside of said combustion zone and oriented so that the axes of said streams emitted from said injectors define the surface of an imaginary cone having its apex within said combustion zone and said streams are mixed in the area of said apex;

means for introducing said first, second and third waste liquids to said first, second and third injectors, respectively, said first liquid having a BTU value below that required for combustion, said second liquid having a BTU value at least high enough to support combustion, and said third liquid having a BTU value significantly greater than said second liquid;

means for supplying combustion-supporting gas to said combustion zone;

means for igniting said waste mixture within said combustion zone;

means for emission of combustion products from said combustion zone;

means for measuring the temperature of combustion products within said combustion zone;

means responsive to said temperature for controlling the rate of injecting at least one of said first and third liquids into said combustion zone; and means for maintaining the temperature of the combustion products at about the temperature existing within said combustion zone for a period of time sufficient to substantially complete conversion of said waste liquids to environmental innocuous products.

7. The system of claim 6 wherein said means for supplying combustion-supporting gases comprises adjustable air inlet means.

8. The system of claim 6 in which said wall means includes an annular wall forming a combustion chamber having an inlet opening for admission of one or more of said unconfined waste streams and an outlet opening for emission of combustion products, and in which said combustion supporting gas means includes secondary means for bringing combustion supporting gas into contact with said combustion products adjacent to said outlet opening of said combustion chamber.

9. The system of claim 8 wherein said wall means further includes an outer wall surrounding at least a portion of said combustion chamber wall and forming an annular zone comprising a passageway for air to pass around said combustion chamber wall and contact said combustion products adjacent to said outlet opening of said combustion chamber.

10. The system of claim 8 wherein said means for maintaining the temperature of the combustion products comprises a rotary kiln having an inlet in communication with said outlet opening of said combustion chamber.

11. The system of claim 6 wherein means are provided for maintaining the temperature of the combustion products above at least about 2,000° F. for at least about 2 seconds.

12. A process for buring liquid wastes comprising:

providing a first liquid waste having a BTU content from about 0 to about 80,000 BTU per gallon, a second liquid waste having a BTU content sufficiently high to support combustion, and a third liquid waste having a BTU content greater than that of said second liquid waste and at least about 110,000 BTU per gallon;

separately injecting said first, second and third liquid wastes into a combustion zone as separate unconfined streams, the axes of said streams lying on the surface of an imaginary cone having its apex within said combustion zone, and said streams being directed toward said apex from outside of said combustion zone and oriented so as to form a mixture of said liquid wastes in the immediate area of said apex;

adjusting the rate of flow of at least one of said first and third streams so that said liquid waste mixture is combustible;

introducing combustion-supporting gas into said combustion zone;

igniting said liquid waste mixture;

measuring at least one characteristic of the combustion products; and, controlling the rate of flow of at least one of said first and third streams in response to said measured characteristic.

13. The process of claim 12 wherein the measured characteristic is temperature and the rate of flow of said first stream is controlled in response to said temperature.

14. The process of claim 12 wherein the measured characteristic is temperature and the rate of flow of said third stream is controlled in response to said temperature.

15. The process of claim 12 wherein the measured characteristic is temperature and the rates of flow of both of said first and third streams are controlled in response to said temperature.

16. The process of claim 12 wherein the measured characteristic is the temperature of combustion products within said combustion zone as measured by a thermocouple.

17. The process of claim 12 wherein a major portion of said first liquid waste is water, and said second liquid waste has a BTU value in the range from about 90,000 to about 110,000 BTU per gallon.

18. The process of claim 17 wherein said first liquid waste has a BTU value from about 0 to about 60,000 BTU per gallon.

19. The process of claim 17 wherein said first liquid waste has a BTU value from about 10,000 to about 60,000 BTU per gallon.

20. The process of claim 17 wherein said third liquid waste has a BTU value from about 120,000 to about 130,000 BTU per gallon.

21. A burner for combustion of liquid wastes comprising:

wall means including a wall of refractory material defining a chamber having an inlet and an outlet;

means for injecting first, second and third waste liquids into said chamber, said means comprising first, second and third injectors each having a nozzle for providing a radially diverging spray of waste liquid, said nozzles being positioned outside of said chamber wall so that said sprays of waste liquids enter said chamber inlet as separate unconfined streams;

means for providing a primary combustion-supporting gas within said chamber, said sprays of waste liquids being oriented relative to each other and said chamber wall and said chamber wall confining said sprays so that said waste liquids and said primary combustion-supporting gas are mixed within said chamber and move as a confined stream toward said chamber outlet;

control means for controlling the rate of injecting at least one of said first and third waste liquids relative to the rate of injecting the other of said first and third waste liquids so that said confined stream provides a combustion liquid waste mixture within said chamber, said first waste liquid having a BTU value below that required for combustion, said second waste liquid having a BTU value at least high enough to support combustion, and said third waste liquid having a BTU value sufficiently high for said confined stream to support combustion; and, pilot means for igniting said combustible liquid waste mixture, said ignited mixture sustaining combustion independently of said pilot means and products of said combustion passing out of said chamber through said outlet.

22. A burner according to claim 21 which further includes means for providing a secondary combustion-supporting gas for contacting said combustion products after said combustion products have passed out of said chamber outlet.

23. A burner according to claim 22 in which said means for supplying primary combustion-supporting gas and/or said means for providing a secondary combustion-supporting gas comprise adjustable air inlet means.

24. A burner according to claim 22 in which said wall means further includes an outer wall surrounding at least a portion of said wall of refractory material and forming an annular zone comprising a passageway for said secondary combustion-supporting gas to pass around said wall of refractory material and contact said combustion products adjacent to said outlet opening of said chamber.

25. A burner according to claim 22 which further includes means for maintaining the temperature of the combustion products at about the temperature existing within said chamber for a period of time sufficient to substantially complete conversion of said waste liquids to environmental innocuous products, said maintaining means including means for providing a tertiary combustion-supporting gas for contacting said combustion products downstream of where said combustion products are first contacted by said secondary combustion-supporting gas.

26. A burner according to claim 21 in which said injectors are oriented so that the axes of said sprays converge substantially at a common point lying within said chamber.

27. A burner according to claim 26 in which said inlet and said outlet of said chamber have substantially a common axis and said common point is located substantially on said common axis.

* * * * *